US005653276A

United States Patent [19]

Niernberger

[11] Patent Number: 5,653,276

[45] Date of Patent: Aug. 5, 1997

[54] COMBINATION WALLET AND BILLFOLD

[76] Inventor: Harold A. Niernberger, 90 Madison St., No. 403, Denver, Colo. 80206

[21] Appl. No.: 568,996

[22] Filed: Dec. 7, 1995

[51] Int. Cl.[6] ..... A45C 1/06

[52] U.S. Cl. ..... 150/137; 150/141; 150/147

[58] Field of Search ..... 150/132, 137, 150/139, 141, 147, 149; 224/670, 269

[56] References Cited

U.S. PATENT DOCUMENTS

| | | | |
|---|---|---|---|
| 1,146,524 | 7/1915 | Rolfs | 150/143 |
| 2,597,967 | 5/1952 | Anderson | 150/137 |
| 3,062,364 | 11/1962 | Ziemski | 150/137 X |
| 4,705,086 | 11/1987 | O'Neill | 150/137 X |
| 4,741,372 | 5/1988 | Sontilli | 150/137 |
| 4,784,199 | 11/1988 | Wise | 150/137 X |
| 5,235,728 | 8/1993 | Nordberg | 224/670 X |
| 5,257,656 | 11/1993 | McLeroy | 150/147 X |
| 5,533,656 | 7/1996 | Bonaldi | 224/269 X |

*Primary Examiner*—Allan N. Shoap
*Assistant Examiner*—Christopher J. McDonald
*Attorney, Agent, or Firm*—Welsh & Katz, Ltd.

[57] ABSTRACT

A combination wallet and billfold includes generally rectangular front and back planar wallet members joined along a bottom side and along two lateral sides. At least one of the front and back wallet members has an outside surface defining a currency face. The top side of the wallet members are un-joined to define a pocket between the wallet members where the pocket is configured to receive credit cards and similarly-sized documents. A U-shaped clip is secured to the currency face and is configured to secure paper currency to the currency face. The clip includes first and second generally converging leg portions connected to each other by a connecting portion urging the leg portions toward each other under compressive tension. A retaining strap has a first end joined to one of the lateral sides while a second end extends toward the other lateral side. The wallet includes a fastening means to releasably secure the second end of the retaining strap to the lateral sides so that the paper currency secured to the currency face by the clip is further compressed and secured against the currency face by the retaining strap.

18 Claims, 2 Drawing Sheets

COMBINATION WALLET AND BILLFOLD

BACKGROUND OF THE INVENTION

The present invention relates generally to a billfold or wallet and more specifically to a combination wallet and billfold for securing paper currency, credit cards and the like.

Wallets are known in the art and typically include two or more flexible leather or fabric members joined along three sides to form a pocket capable of retaining paper money. The pocket portion of most wallets does not typically include a fastener device. Thus, paper currency tends to become dislodged from the pocket portion increasing the probability that the money will be lost.

The wallet may be folded in half about a centerline to reduce its length such that it may be easily placed in a user's pant or jacket pocket. Such foldable wallets are often stiff until "broken-in" and are particularly bulky. Users often place a majority of their important documents, such as credit cards, automobile license and registration, insurance cards, medical cards, banking cards and the like in the wallet, since such wallets are often capable of retaining a large number items. Stuffing a wallet with many such items increases its bulk.

Money clips are also known and typically consist of a clip under spring tension into which a folded stack of paper currency is inserted. However, money clips are not adapted to secure credit cards and like items since the cards are typically smooth and can easily become dislodged from the clip. Such clips only hold a limited number of paper bills and in a relative precarious manner.

Accordingly, it is an object of the present invention to substantially overcome the above-described problems.

It is another object of the present invention to provide a combination wallet and billfold.

It is a further object of the present invention to provide a combination wallet and billfold configured to securely retain paper currency and credit cards.

It is also an object of the present invention to provide a combination wallet and billfold that is light-weight and compact in size.

It is still an object of the present invention to provide a combination wallet and billfold that securely retains paper currency and credit cards with a fastening strap.

It is yet another object of the present invention to provide a combination wallet and billfold having hook and loop or metal clip and eye-type fasteners to securely hold paper money and credit cards.

SUMMARY OF THE INVENTION

The disadvantages of present wallets and money clips are substantially overcome with the present invention by providing a novel combination wallet and billfold. The novel invention includes a money clip for securing a folded stack of paper currency against a currency face of the wallet. A retaining strap is secured across the face of the wallet to hold the money and credit cards in place. Thus, the money is secured to a face of the wallet using both the money clip and the retaining strap. This provides an extremely secure method for retaining the paper currency.

Additionally, the wallet includes a pocket part for retaining credit cards and like items and includes a slotted front portion for retaining often used credit card items which can be quickly removed and inserted. The pocket portion is releasably sealed with a hook and loop fastener so that the cards cannot become inadvertently dislodged from the pocket. The retaining strap similarly includes a hook and loop fastener to secure to strap about the wallet. Further, the retaining strap retains the credit cards inserted into the slots in the front portion.

The combination wallet and billfold is economical to produce as it is formed from two sections of material joined by stitching along three edges. The fourth edge remains un-joined to form a pocket portion between the sections of material.

More specifically, the combination wallet and billfold of the present invention includes generally rectangular front and back planar wallet members joined along a bottom side and along two lateral sides. At least one of the front and back wallet members has an outside surface defining a currency face. The top side of the wallet members is un-joined to define a pocket portion between the wallet members where the pocket portion is configured to receive credit cards and similarly-sized documents. A U-shaped clip is secured to the currency face and is configured to secure paper currency to the currency face. The clip includes first and second generally converging leg portions connected to each other by a connecting portion urging the leg portions toward each other under compressive tension. A retaining strap has a first end joined to one of the lateral sides while a second end extends toward the other lateral side. The wallet includes a fastening means to releasably secure the second end of the retaining strap to the other lateral side so that the paper currency secured to the currency face by the clip is further compressed and secured against the currency face by the retaining strap.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
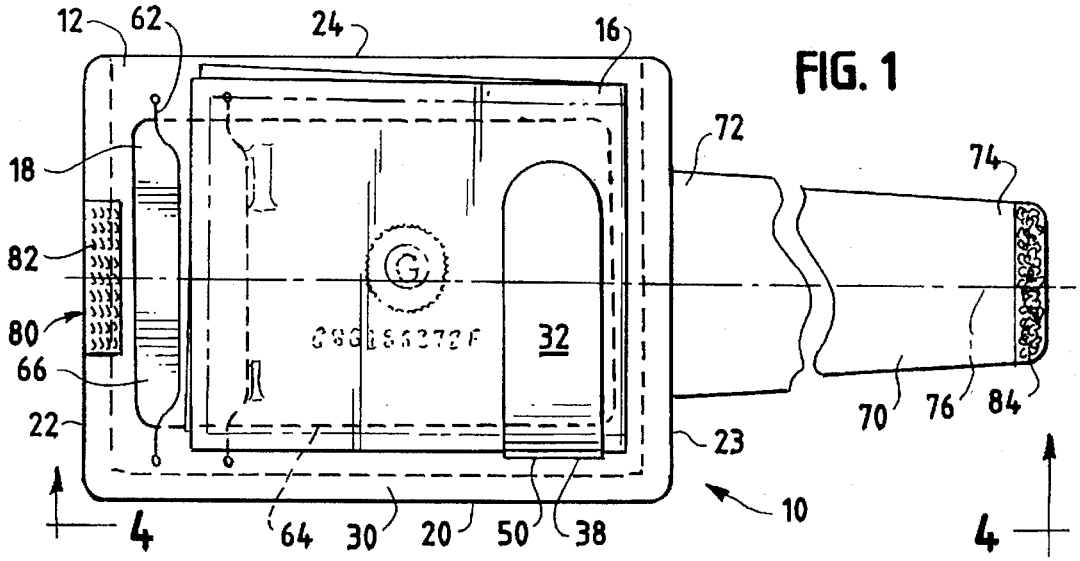
FIG. 1 is a top plan view of a specific embodiment of a combination wallet and billfold according to the present invention, shown with the retaining strap unfastened.
Figure 2:
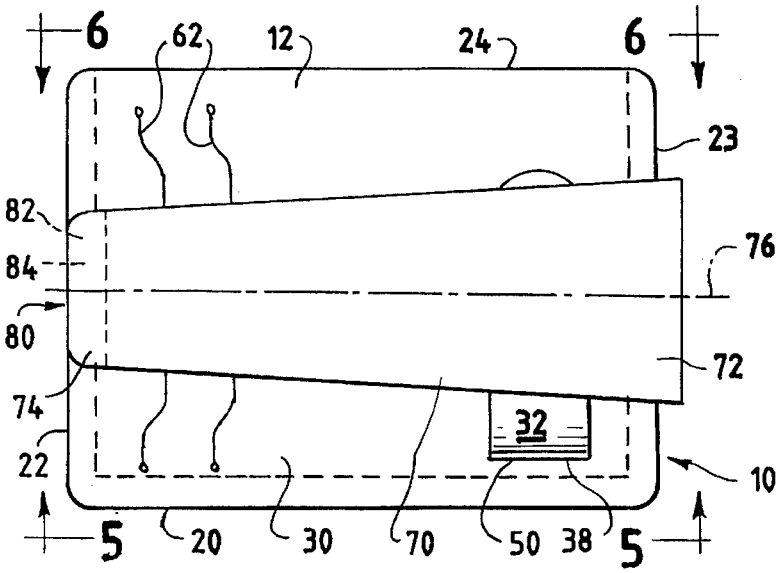
FIG. 2 is a top plan view of the combination wallet and billfold of FIG. 1, shown with the retaining strap fastened.
Figure 3:
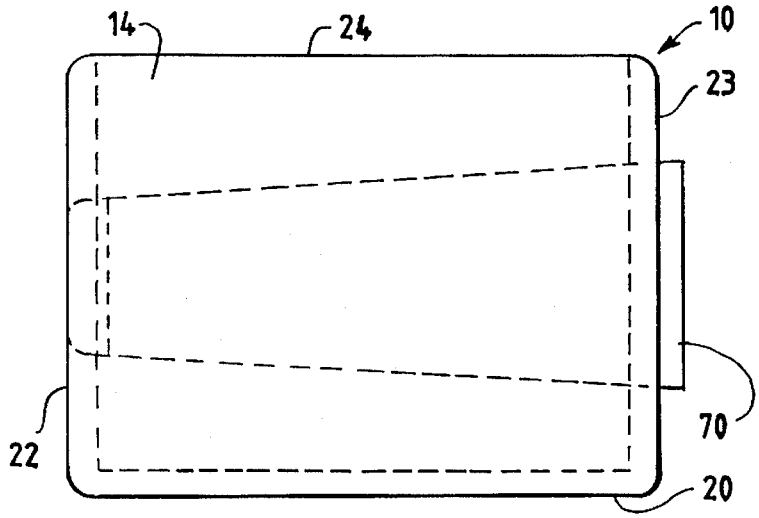
FIG. 3 is a bottom plan view of the combination wallet and billfold of FIG. 1.
Figure 4:
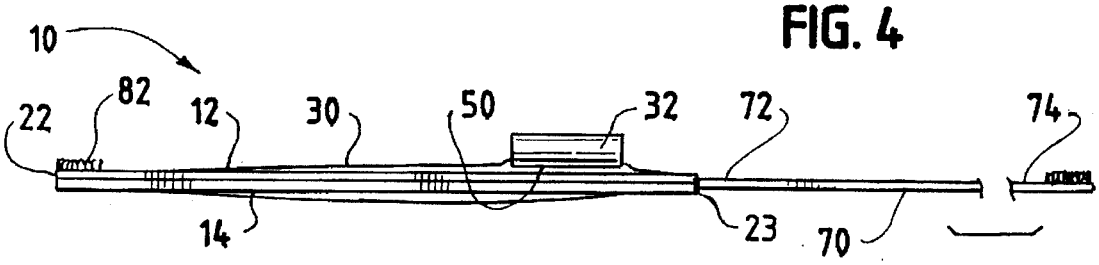
FIG. 4 is a side elevational view of the combination wallet and billfold of FIG. 1, taken along the line 4—4 of FIG. 1 in the direction generally indicated.
Figure 5:
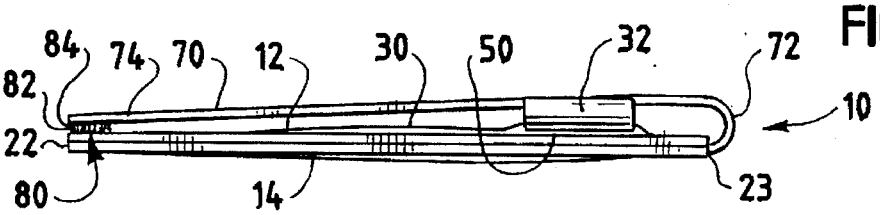
FIG. 5 is a side elevational view of the combination wallet and billfold of FIG. 2, taken along line 5—5 of FIG. 2 in the direction generally indicated.
Figure 6:
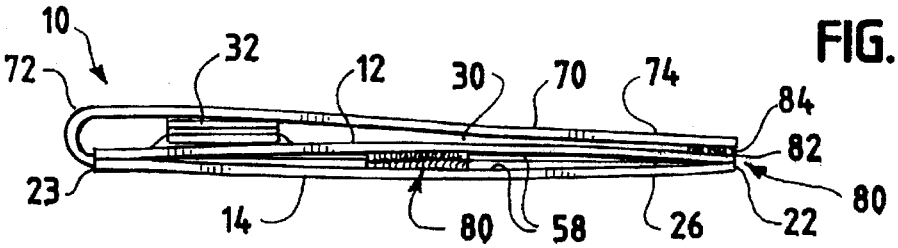
FIG. 6 is a side elevational view of the combination wallet and billfold of FIG. 2, taken along the line 6—6 of FIG. 2 in the direction generally indicated, particularly showing the pocket portion.

Referring now to FIGS. 1–6, a combination wallet and billfold 10 is shown generally and will be referred to interchangeably as "the wallet" hereinafter. The wallet 10 is formed from a front planar wallet member 12 and a back planar wallet member 14. The wallet members 12 and 14 are preferably formed from leather, vinyl, plastic, natural or synthetic fabric or any other suitable material. The wallet members 12 and 14 are generally rectangular in shape and are preferably dimensioned to be about approximately four inches in length and three inches in width. The width of each wallet member 12 and 14 corresponds approximately to the width of conventional paper currency 16 (FIG. 1) while the length of each wallet member is approximately twenty-five percent longer than the length conventional paper currency when the currency is folded in half about its midsection. Such an increased length is useful for accommodating insertion of credit cards 18 (FIG. 1) or similarly-sized items into the wallet 10, as will be described in greater detail hereinafter.

The front and back wallet members 12 and 14 are coplanar and are joined or sewn together along a bottom side 20 and along each of two opposite lateral sides 22 and 23. The bottom side 20 is parallel to a top side 24 with both the top and bottom sides being transverse to the lateral sides 22 and 23 thus, defining a rectangle. However, any suitable shape may be used. The wallet members 12 and 14 are preferably joined using conventional stitching about the bottom side 20 and the lateral sides 22 and 23, as is known in the art. Alternately, a suitable chemical adhesive or other suitable fastening means may be used. The top side 24 of the wallet members 12 and 14 is not stitched so that a pocket portion 26 (FIG. 6) is formed between the wallet members. The pocket portion 26 is configured to receive and retain the credit cards 18 and other similarly-sized items.

The front wallet member 12 has a generally planar outside face portion defining a currency face 30 against which the folded stack of paper currency 16 is retained. The back wallet member 14 is coplanar with the front wallet member 12 and provides a surface configured to receive an artistic or ornamental design, such as a logo or other design. The design may be painted, engraved or stamped into the material from which the wallet 10 is formed, as is known in the art.

Figure 7A:
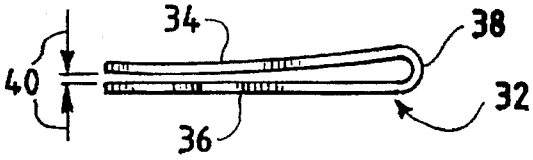
FIG. 7A is a side elevational view of a clip shown in FIG. 1.
Figure 7B:
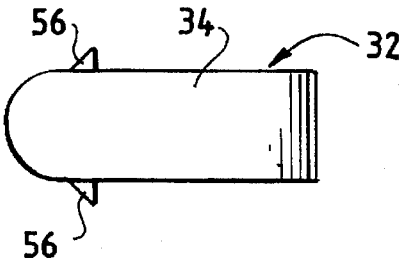
FIG. 7B is a top plan view of a clip shown in FIG. 7A.
Figure 7C:
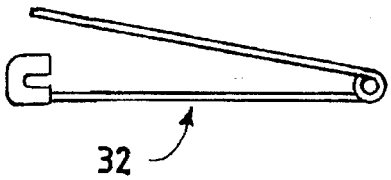
FIG. 7C is a side elevational view of a safety-pin type clip.

Referring now to FIGS. 1 and 7A–7B, a U-shaped clip 32 or money clip is secured to the currency face 30 and is configured to secure and firmly retain the paper currency 16 against the currency face. The money clip 20 includes a first leg portion 34 and a second leg portion 36 which generally converge toward each other at distal ends. The leg portions 34 and 36 are connected to each other by an arcuate connecting portion 38 which urges the leg portions toward each other under compressive spring tension, as shown by arrow 40 (FIG. 7A). The clip 32, for example, may be formed from metal, plastic, wood, fabric and the like, or any other suitable material capable of retaining paper currency in a pinching manner.

Preferably, the second leg portion 36 is inserted through a slot 50 or opening disposed in the front wallet member 12 such that only the first leg portion 34 and the connecting portion 38 are visible. Since the second leg portion 36 penetrates the thickness of the front wallet member 12, the front wallet member is essentially "pinched" between the first and second leg portions 34 and 36. The stack of folded paper currency 16 is compressively placed under the first leg portion 34 of the money clip 32 and is securely pinched between the first leg portion and the currency face 30. Thus, the stack of paper currency lays flat along the currency face 30 firmly held in place by the compressive effect of the money clip 32.

Preferably, the second leg portion 36 includes one or more tabs 56 projecting laterally from the clip 32 and integrally formed therewith. The tabs 56 may be triangular in shape to facilitate one-way insertion into the slot 50. After the second leg portion 36 and the tabs 56 are inserted into the slot 50, essentially stretching the slot, the clip cannot be easily removed since the tabs engage the edge of the slot. Inside surfaces 58 (FIG. 6) of the front and back wallet members 12 and 14 may be lined with a thin fabric or plastic lining (not shown) to increase aesthetic appeal and to prevent the second leg portion 36 from projecting into the pocket portion 26 and contacting the credit cards 18 retained within the pocket.

Alternately, the money clip 32 may be secured within the slot 50 by a suitable chemical adhesive exclusively, or in conjunction with the tabs 56. The clip 32 may also be affixed to the surface of the currency face 30 with a suitable chemical adhesive, rivet or other fastener so as not to project through the thickness of the front wallet member 12.

However, the money clip 32 need not be limited to a U-shaped clip and may be, for example, a safety-pin type clip (not shown) having a thin bar under spring tension fastened at one end by a hook. In such an arrangement, the thin bar bisects the paper currency 16 midway across its width so that the currency is folded in half and retained by the safety-pin bar.

Referring now to FIGS. 1–6, the front wallet member 12 includes one or more card slots 62 extending through the thickness of the front wallet member and the currency face 30. The card slots 62 are preferably disposed near the left lateral side 22 and are arranged parallel to each other and parallel to the lateral side. The card slots 62 are dimensioned to snugly receive the credit card 18 therethrough such that a larger portion 64 (FIG. 1) of the credit card is received through the card slot and is retained within the pocket portion 26 or between the front wallet member 12 and the inside lining. A remainder or smaller visible portion 66 (FIG. 1) of the credit card 18 is disposed against the currency face 30 to permit the credit card to be quickly and easily gripped by the user without requiring the user to open the pocket portion 26.

A retaining strap 70 has a first end 72 preferably joined to the right lateral side 23 of the wallet 10 opposite the card slots 62. The first end 72 of the retaining strap 70 is fastened between the first and second wallet members 12 and 14 and extends a slight distance into the right lateral side 23 so that when the edges of the wallet members are sewn or fastened together, the retaining strap is firmly sewn therebetween. A second end 74 of the retaining strap 70 extends toward the left lateral side 22 and releasably fastens to that side. When the second end 74 of the retaining strap 70 is fastened, the paper currency 16 secured to the currency face 30 by the clip 32 is further compressed and secured against the currency face by the retaining strap. The retaining strap 70 also secures the credit cards 18 within the card slots 62 by substantially inhibiting longitudinal displacement of the credit cards within the card slots. Thus, with the retaining strap 70 fastened, the paper currency 16 and the credit cards 18 are securely retained within the wallet 10.

The retaining strap 70 is preferably formed from the same material as the front and back wallet members 12 and 14 and is tapered along a longitudinal axis 76 (FIGS. 1–2) for aesthetic appeal. The retaining strap 70 is flexible and resilient so that the paper currency 18 is compressed and securely retained against the currency face 30 when the retaining strap is fastened.

The second end 74 of the retaining strap 70 is preferably fastened to the front wallet member 12 using a hook and loop fastener 80. Such a fastener, for example, may be manufactured under the trademark of VELCRO. The hook portions 82 may be disposed on either the retaining strap 70 or the front wallet member 12 while loop portions 84 are disposed on the opposite portion. Alternately, the fastener may be a metal clip and eye-type fastener (not shown) which may fasten using an interference fit or a magnetic element, as is known in the art.

Additionally, the top side 24 of the pocket portion 26 includes the hook and loop fastener 80 (FIG. 6) or the metal clip and eye-type fastener so that the pocket portion may be releasably sealed to securely retain credit cards and like items within the pocket portion.

Specific embodiments of a combination wallet and billfold according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A combination wallet and billfold comprising:

generally rectangular front and back planar wallet members joined along a bottom side and two lateral sides thereof, at least one of the front and back wallet members having an outside surface defining a currency face;

the lateral sides being transverse to the bottom side and a top side;

the top side of the wallet members being un-joined to define a pocket between the wallet members, said pocket configured to receive credit cards and similarly-sized documents therein;

a clip secured to the currency face configured to secure paper currency to the currency face;

a retaining strap having a first end thereof joined to one of the lateral sides and extending toward the other of the lateral sides; and strap fastening means to releasably secure a second end of the strap to the other of the lateral sides so that the paper currency secured to the currency face by the clip is further compressed and secured against the currency face by the retaining strap.

2. The combination wallet and billfold according to claim 1 wherein the wallet members have a width corresponding to about the width of the paper currency to be retained thereon.

3. The combination wallet and billfold according to claim 1 wherein the wallet members have a length about twenty-five percent greater than one-half of the length of the paper currency to be retained thereon.

4. The combination wallet and billfold according to claim 1 wherein the paper currency retained by the clip is folded about a midline of the paper currency so that the folded paper currency is about equal in length and width to the length and width of the wallet members.

5. The combination wallet and billfold according to claim 1 wherein the top side of the wallet includes hook and loop fastening means configured to releasably seal the pocket.

6. The combination wallet and billfold according to claim 1 wherein the top side of the wallet includes a metal clip and eye-type fastener configured to releasably seal the pocket.

7. The combination wallet and billfold according to claim 1 wherein the clip is a U-shaped clip.

8. The combination wallet and billfold according to claim 1 wherein the clip is a safety-pin type spring clip.

9. The combination wallet and billfold according to claim 7 wherein the U-shaped clip includes first and second converging leg portions connected to each other by a connecting portion to urge the leg portions toward each other under tension, one of the first and second leg portions extending into and through a portion of the currency face and the other leg portion substantially coplanar with the currency face, said clip configured to receive and secure paper currency between the currency face and the other of the first and second leg portions.

10. The combination wallet and billfold according to claim 1 wherein the clip is formed from the group of materials consisting of metal, plastic, wood and fabric.

11. The combination wallet and billfold according to claim 1 wherein the strap fastening means includes a hook and loop fastener.

12. The combination wallet and billfold according to claim 1 wherein the strap fastening means includes a metal clip and eye-type fastener.

13. The combination wallet and billfold according to claim 1 wherein the strap fastening means includes a hook and loop fastener such that the hook portions are disposed on one of the retaining strap and the currency face and the loop portions are disposed on the other of the retaining strap and the currency face.

14. The combination wallet and billfold according to claim 1 wherein the strap fastening means includes a metal clip and eye-type fastener such that the metal clip is disposed on one of the retaining strap and the currency face and the eye-type fastener is disposed on the other of the retaining strap and the currency face.

15. The combination wallet and billfold according to claim 1 wherein the currency face includes at least one slot extending through a thickness thereof, said slot dimensioned to receive a portion of the card therethrough such that the portion of the card received through the slot is contained within the pocket and a remainder of the card is graspingly disposed against the currency face to permit the card to be operatively gripped by a user.

16. The combination wallet and billfold according to claim 15 wherein the retaining strap, when secured by the strap fastening means, secures the card within the slot and substantially prevents displacement of the card.

17. An article for carrying currency, the article comprising:

generally rectangular front and back planar members joined along at least two lateral sides thereof, at least one of the front and back planar members having an outside surface defining a currency retaining face;

a clip secured to the currency retaining face configured to secure paper currency to the currency face;

a retaining strap having a first end thereof joined to one of the lateral sides and extending toward the other of the lateral sides; and strap fastening means to releasably secure a second end of the retaining strap to the other of the lateral sides so that the paper currency secured to the currency face by the clip is further compressed and secured against the currency face by the retaining strap.

18. A combination wallet and billfold comprising:

generally rectangular front and back planar wallet members joined along a bottom side and two lateral sides thereof, at least one of the front and back wallet members having an outside surface defining a currency face;

the lateral sides being transverse to the bottom side and a top side;

the top side of the wallet members being un-joined to define a pocket between the wallet members, said pocket configured to receive credit cards and similarly-sized documents therein;

a U-shaped clip secured to the currency face configured to secure paper currency to the currency face, said clip having first and second generally converging leg portions connected to each other by a connecting portion urging the leg portions toward each other under compressive tension;

a retaining strap having a first end thereof joined to one of the lateral sides and extending toward the other of the lateral sides;

fastening means to releasably secure a second end of the retaining strap to the other of the lateral sides so that the paper currency secured to the currency face by the clip is further compressed and secured against the currency face by the retaining strap; and pocket fastening means disposed on the top side of the wallet members configured to releasably seal the pocket to retain the cards therein.

* * * * *